US006425727B1

(12) United States Patent
Hood

(10) Patent No.: US 6,425,727 B1
(45) Date of Patent: Jul. 30, 2002

(54) QUICK MOUNT TRUCK LIFT

(76) Inventor: Kyle Hood, 5100 Midridge Ct., Wake Forest, NC (US) 27587

( * ) Notice: Subject to any disclaimer, the term of this patent is extended or adjusted under 35 U.S.C. 154(b) by 0 days.

(21) Appl. No.: 09/828,425

(22) Filed: Apr. 9, 2001

(51) Int. Cl.[7] ..... B66C 23/36

(52) U.S. Cl. ..... 414/543; 414/550; 414/541; 212/180

(58) Field of Search ..... 414/543, 541, 414/550; 212/180

(56) References Cited

U.S. PATENT DOCUMENTS

| | | | | | |
|---|---|---|---|---|---|
| 1,448,814 | A | * | 3/1923 | Norris | 414/543 |
| 3,019,918 | A | * | 2/1962 | Keener | 414/543 |
| 3,048,371 | A | * | 8/1962 | Klimek, Jr. | 212/180 X |
| 3,978,989 | A | * | 9/1976 | Avila, Jr. | 212/180 |
| 5,054,989 | A | * | 10/1991 | Fell | 414/607 |
| 5,431,526 | A | * | 7/1995 | Peterson et al. | 414/543 |
| 5,725,112 | A | * | 3/1998 | Thorby | 212/180 |

FOREIGN PATENT DOCUMENTS

| | | | | |
|---|---|---|---|---|
| GB | 657326 | * | 9/1951 | 414/543 |
| WO | 99/08955 | * | 2/1999 | |

* cited by examiner

*Primary Examiner*—Steven A. Bratlie
(74) *Attorney, Agent, or Firm*—Mills Law Firm PLLC

(57) ABSTRACT

A hoist for loading and unloading cargo from the bed of a truck includes a support member attached to the bed of the truck carrying a vertical mast for rotation about a vertical axis having a variable length boom pivotally connected at a lower end for rotation about a horizontal axis. A tie chain is connected between the upper end of the boom and mast varies the inclination of the boom member with respect to the mast member and the bed of the truck enabling the upper end of the boom to be accurately positioned with respect to select areas of the truck bed. An electric winch and cable are used for raising and lower cargo to and from the truck bed.

12 Claims, 4 Drawing Sheets

QUICK MOUNT TRUCK LIFT

FIELD OF THE INVENTION

The present invention relates to vehicular mounted lifts, and, in particular, a winch operated lift for placing and removing cargo from the bed of a truck.

BACKGROUND OF THE INVENTION

Lighter duty trucks, such as pick-up trucks, are versatile transports for a wide variety of cargo. Light-weight materials can be easily loaded and unloaded from the raised bed. Heavier materials, however, are difficult and lift accessories, such as forklifts and external lifts, are required. Inasmuch as such supplemental equipment is not always available throughout the normal use and travel of the truck, various truck mounted hoists have been proposed in the art for permitting the operator, without assistance, to place and remove cargo from the truck bed. Such hoists have tended to be costly, heavy and bulky, and require structural alteration to the truck body.

For example, U.S. Pat. No. 2,947,425 to Nichols discloses a truck hoist having a pivotal lifting arm, mounted at the top of a truck bed mounted support pole, that is raised or lowered by a hydraulic cylinder. The hoist is permanently installed on the truck body. A similar hydraulically operated hoist is disclosed in U.S. Pat. No. 4,069,922 to Hawkins. U.S. Pat. No. 4,556,358 to Harlan discloses a truck hoist also using a hydraulic cylinder for raising a pivoting boom thereby raising and lowering a fixed length cable for moving cargo to and from the truck bed. Similar hydraulic hoists are disclosed in U.S. Pat. Nos. 4,7100,090 to DeLuca et al. and 4,671,731 at Harlan. The use of fixed cable lengths limits the pick and place accuracy of the hoist. Other hoists have provided cable winches to assist in raising and lower cargo in combination with truck mounted masts and pivotal booms as disclosed in U.S. Pat. Nos. 5,445,487 to Koscinski, and 6,138,991 to Myers. Fixed height booms are also disclosed in U.S. Pat. Nos. 5,765,809 to Baker, 3,899,089 to Wardlaw, and 6,085,349 to O'Meara. In an effort to overcome the foregoing limitations, it would be desirable to provide a hoist for a truck bed that loads and unloads cargo of varying shapes and sizes with minimal effort and maximum accuracy, readily deploys and stows without affecting cargo space, and incorporated with a minimum of alterations to the truck bed.

SUMMARY OF THE INVENTION

The foregoing objects are accomplished by an easily mounted hoist having a pivotal mast attached at a comer of the truck bed for rotation about a vertical axis and an extendable telescopic boom pivotally supported at a lower end for rotation about a vertical axis at an inclination provided with an adjustable boom chain. An electric winch carried on the boom controls a lifting cable at the top of the boom. The chain and boom may be readily removed or collapsed for convenient storage without affecting the load carrying capacity of the truck bed. The dual pivotal axes and extendable boom permit ready orientation of the cable for accurately picking and placing cargo to and from the truck body. The selective pivoting and extending of the boom allows transfer of tall cargo. The electric winch is readily connected to the vehicle power supply and provides substantial lifting capacity. The present invention provides a quick mount hoist for trucks that may be readily deployed for transferring cargo and disassemble and stowed permitting full capacity operation for transporting.

Accordingly, it is an object of the invention to provide a truck mounted lift that may be readily deployed and stowed without limiting truck bed capacity.

Another object of the invention is to provide a truck bed mounted lift having a biaxially pivotal boom for accurate placement and removal of cargo from a truck bed.

A further object of the invention is to provide a winch operated pivotal boom lift that may be mounted on a truck bed with minimal operations.

Yet another object of the invention is to provide a truck bed lift with a fully adjustable boom and electrical winch cable for loading and unloading cargo.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
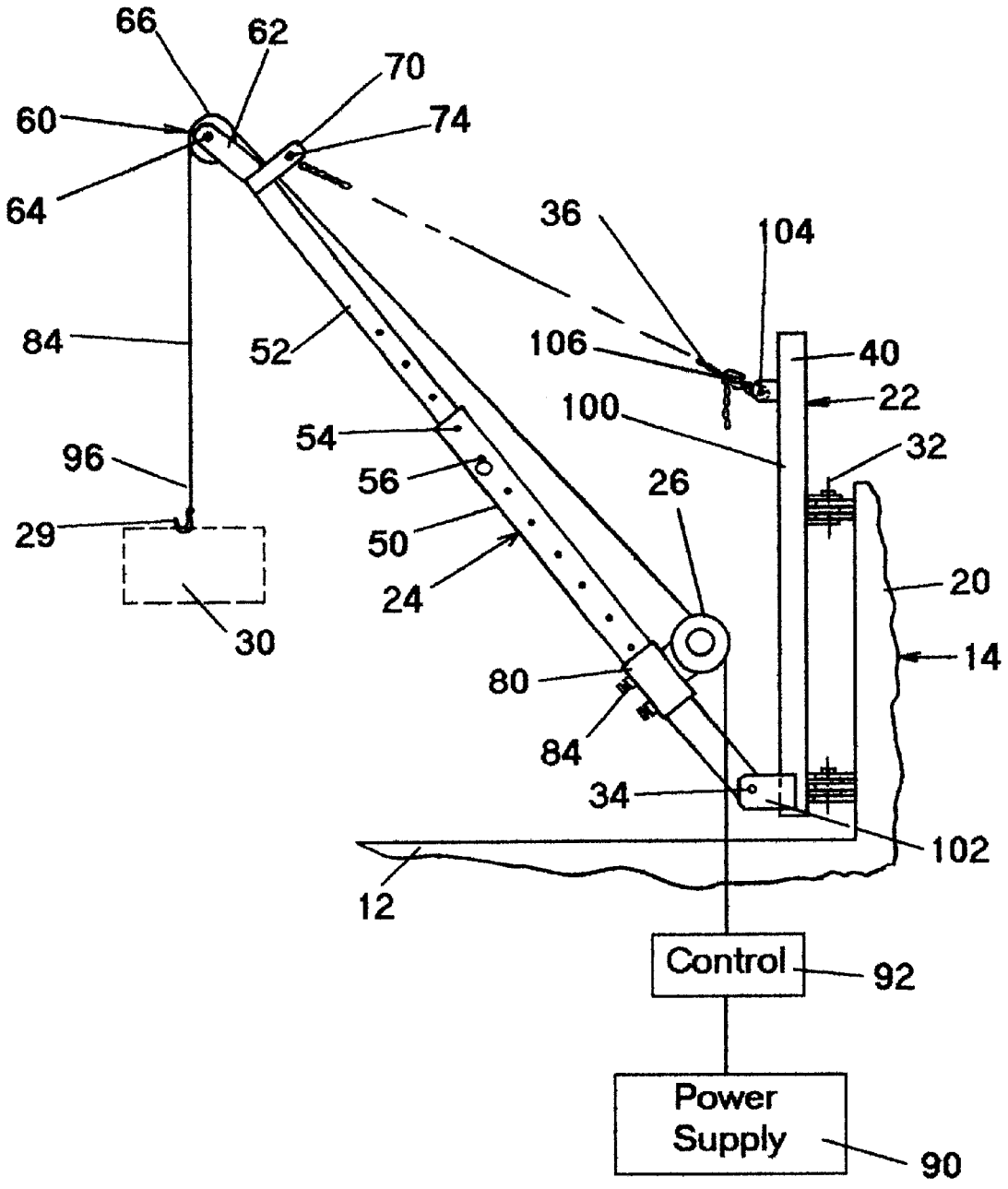
FIG. 1 is an rear view of a quick mount hoist mounted on a truck bed.

Referring to the drawings for the purpose of describing the preferred embodiments and not for limiting same, FIG. 1 illustrates a quick mount hoist assembly 10 mounted at the rear comer of a truck bed 12 of a pickup truck 14.

The hoist assembly 10 includes a support base 20, attached to the truck bed 12, as described below, pivotally carrying a vertical mast 22 to which a lift boom 24 is pivotally connected at a lower end. The hoist assembly 10 includes a winch 26 for controlling a winch cable 28 including a lifting hook 29 for raising and lowering cargo 30 to and from the truck bed 12. The mast 22 is pivotal relative to the support base 20 about a vertical axis 32. The lift boom 24 is pivotally connected at the lower end to the mast 22 at a horizontal axis 34 and supported at an operator selected angular position by a chain link boom tie member 36 extending between the upper end 38 of the boom 24 and the upper end 40 of the mast 22. Accordingly, it will be appreciated, that a lift operator, by varying the effective length of the boom 24 and adjusting the inclination of the boom 24, may position the position of the lift hook 29 universally with respect to the truck bed 12 for selective access to the desired cargo position.

The boom 24 includes a lower boom sleeve 50 that telescopically receives an upper boom sleeve 52. The boom sleeves are provided with a longitudinal series of adjusting pin holes 54 at the sides thereof that receive locking pins 56 for selectively varying the length of the boom 24. Preferably, the boom sleeves are constructed of heavy gage rectangular tubing. A cable guide assembly 60 is attached at the upper end of the upper boom sleeve 52. The cable guide assembly 60 includes laterally spaced arms 62 having a cross pin 64 rotatably supporting a grooved cable guide wheel or pulley 66. The arms 62 are upwardly and inwardly inclined with respect to the boom 24 whereby the lower run 68 of the winch cable 28 is progressively inclined toward the pulley from the winch 26.

An outwardly extending chain support 70 is attached to the boom 24 at the guide assembly 60. The chain support 70 removably carries a cross pin 74 that extends through a terminal link in the boom tie member 36 to attach the upper end of the chain thereto.

The electric winch 26 is mounted on a support sleeve 80 slidably disposed over the lower boom sleeve 22. A pair of set bolts 84 are connected on the bottom surface of the support sleeve 80. Accordingly, the support sleeve 80 and associated winch 26 may be variably longitudinally positioned on the lower boom sleeve 50 and locked thereto by tightening of the set bolts 84. The winch 26 may be a commercially available design having sufficient capacity for raising cargo 30 in accordance with design specification. The winch 26 is connected with the truck power supply 90 and operated by a fixed or tethered control box 92 in a conventional manner. The vertically disposed outer run 85 of the winch cable 28 terminates with a tensioned weight 96 and the lifting hook 29 for attachment to the cargo 30 to be maneuvered.

The mast 22 includes an elongated, vertically disposed, support bar 100 having a lower boom support bracket 102 and an upper chain support bracket 104. The boom support bracket 102 includes outwardly extending legs for receiving the lower end of the lower boom sleeve 50 and pivotal connection thereto by removable pivot pin at the axis 34. The chain support bracket 104 is attached at the upper end of the support bar 100 and projects transversely inwardly thereof. A chain hook 106 is pivotally attached to the chain support bracket 104 by removable cross pin 108. Accordingly, it will be appreciated that the chain links may be variably engaged with the chain hook 106 for changing the effect length of the chain and thereby vary the inclination of the boom 24 with respect to the mast 22.

Figure 2:
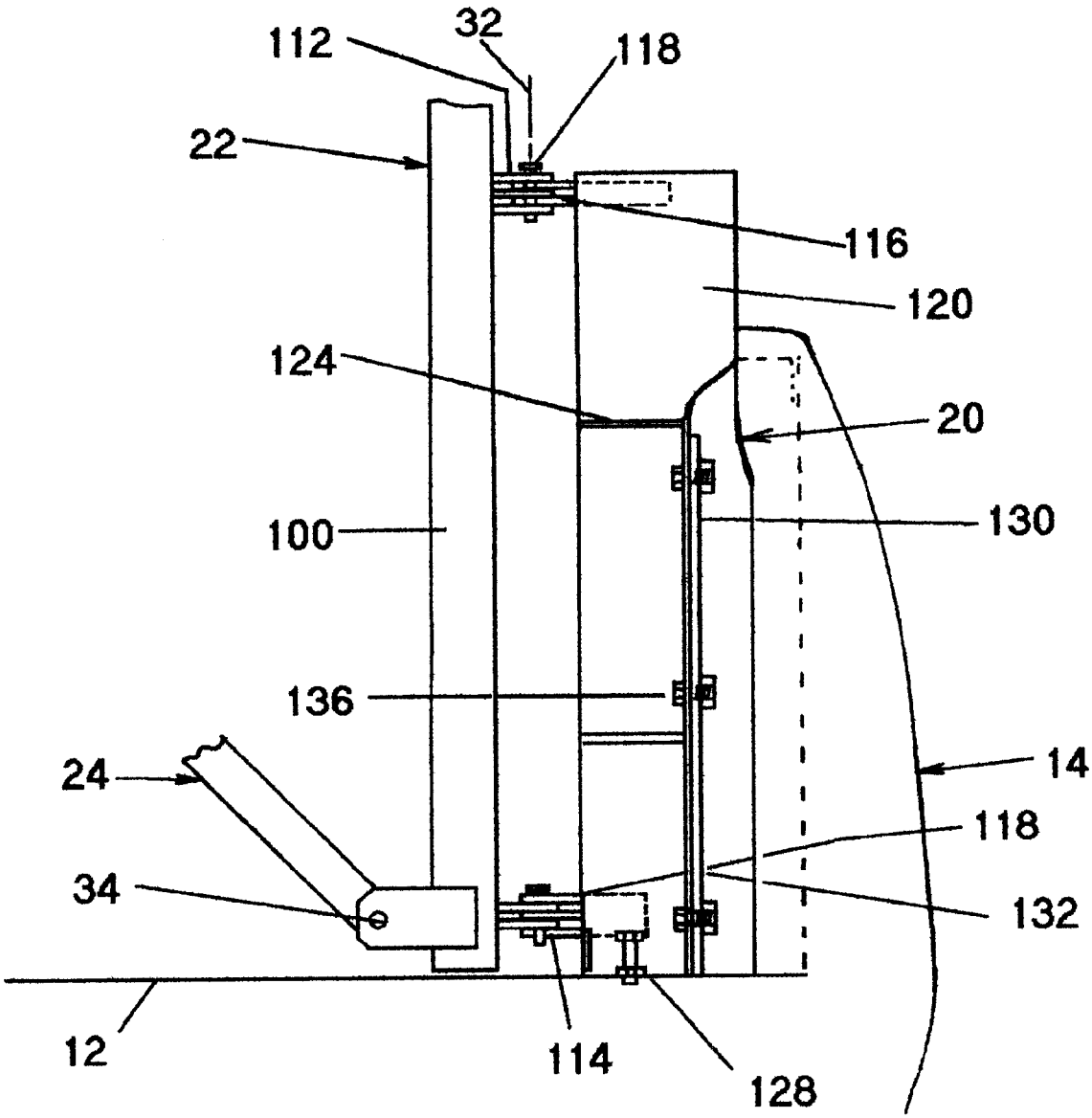
FIG. 2 is an enlarged end view of the hoist on the truck illustrating details of the mast support mounting.
Figure 3:
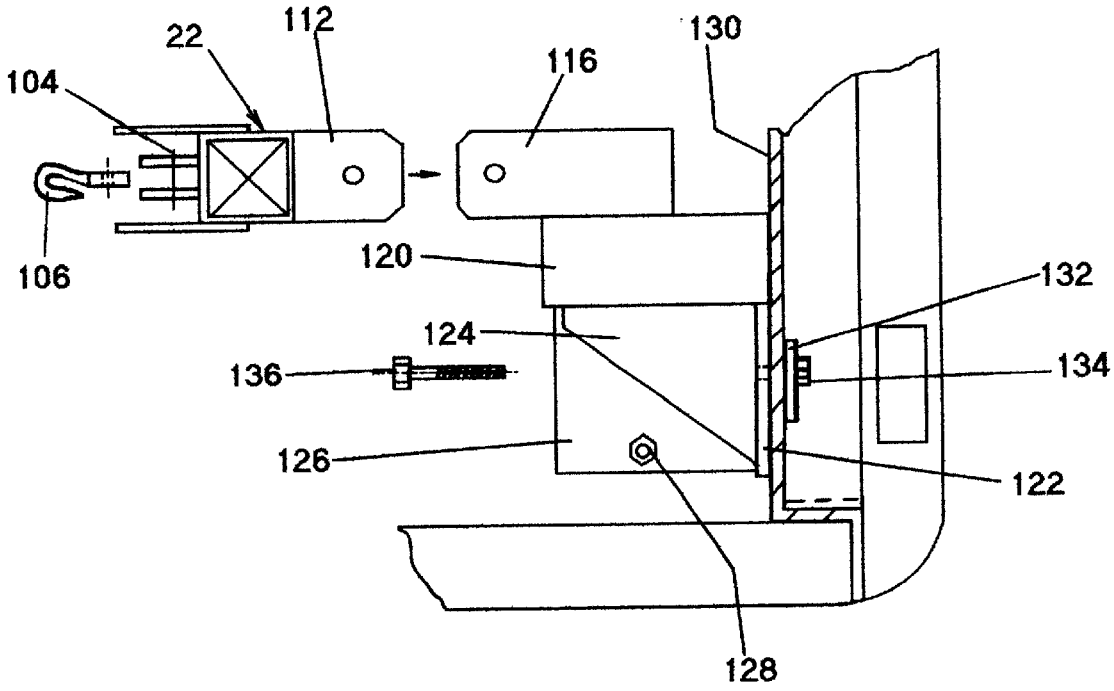
FIG. 3 is a partially exploded top view of the mast support mounting for attachment on the truck bed and attachment of the mast.

Referring to FIGS. 2 and 3, the outboard sides of the support bar 100 are provided with lower hinge plates 110 and upper hinge plates 112. As shown in FIG. 2, the hinge plates 110, 112 intermesh with complementary hinge plates 114, 116 on the support base 20 and interconnected by removable hinge pins 118 thereby establishing the vertical axis 32 for relative pivotal movement of the boom relative to the truck bed 16.

The support base 20 includes a rectangular support post 120 and a vertical side plate 122 mutually joined at seam welds and reinforced by a plurality of vertically spaced triangular gussets 124. The support base 20 includes a bottom plate 126 that engages the truck bed frame directly. An adjusting screw 128 carried on the bottom plate 126 may be selectively adjusted by shimming the support base 20 alignment after to final connection to the truck. The side plate 122 is provided with a vertical series of apertures that are aligned with corresponding apertures in the adjacent truck bed side panel 130. An elongated backing strap 132 is positioned on the interior surface of the side panel 130. The backing strap 132 carries welded nuts 134 at apertures therein alignable with the corresponding apertures in the side panel 130 and side plate 122. Threaded fastener 136 compressively interconnect the backing strap 132 and side plate 122 and the panel 130.

Figure 4:
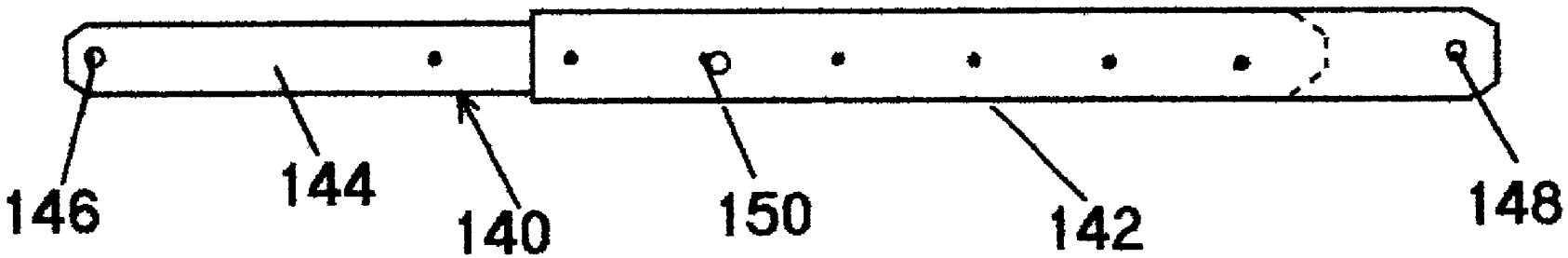
FIG. 4 is a side view of a boom bar for use in an embodiment of the invention.

Referring to FIG. 4, as an alternative to the link chain, a solid telescoping boom bar 140 may be employed. The boom bar 140 includes a lower outer sleeve 142 that telescopically receives an inner upper sleeve 144. The sleeves include cross holes 146, 148 for attachment to the boom and the mast, respectively, with the aforementioned connector pins. The sleeves includes longitudinally spaced apertures for variable length interconnection with removable cross pins 150.

The hoist may be transported in assembled or partially disassembled condition. For assembled transport, the boom chain tie member 36 is released and the boom collapsed, and the compact boom 24 is pivoted and stowed against the side wall of the truck bed. For operation, the boom 24 is outwardly pivoted for operator access, the boom sleeves are telescoped and locked at the desired boom length, and the boom chain connected at the lower end to the mast for providing the desired boom inclination about the axis 34. Thereafter the boom cable hook is positioned over the cargo location, lowered for attachment and raised by the winch. The mast and boom are then pivoted about the vertical axis 32 to the desired transfer position, the cable lowered and the cargo released. The hoist may be conveniently further disassembled for transport by removing the lower connector pin between the boom and the mast. Further an electrical adapter may be provided adjacent the hoist and permanently connected with the vehicle power supply. The control cable and winch power cable may be removably interface with the adapted and carried remotely during non-use periods.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A hoist for loading and unloading cargo from the bed of a truck having a vertical inner side wall, comprising: an elongated vertical support member having a lower end engaging the bed, a middle section extending vertically along the inner side of the inner side wall and an upper end extending above the inner side wall; a reinforcing member for engagement with the outer side of said inner side wall; fastening means for fixedly attaching said middle section of said support member to said reinforcing member through apertures in the side wall; a vertically extending mast member; upper and lower hinge members pivotally connecting said mast member to said middle section of said support member for rotation about a vertical axis; a variable length boom member pivotally connected at a lower end to the lower end of said mast member for rotation about a horizontal axis; an elongated tie member adjustably connected between the upper end of said boom member and the upper end of said mast member whereby selective adjustment of the length of said tie member varies the inclination of the boom member with respect to the mast member and said bed of said truck thereby enabling said upper end of said boom member to be accurately positioned with respect to select areas of said truck bed; cable guide means carried on said upper end of said boom member; and winch means carried on said boom member and including a lifting cable extending along said boom member and operatively about said cable guide means and downwardly therefrom, said lifting cable terminating with lifting means for removable attachment to said cargo, the arrangement enabling stowing of said boom member and said mast member along said side wall by releasing said tie member and lowering said boom member about said horizontal axis and pivoting the lowered boom member and mast member about said vertical axis for juxtaposition along said inner side wall of the truck bed.

2. The hoist as recited in claim 1 wherein said winch means includes an electrically operated winch operatively connected with the power supply of the vehicle and including control means for controlling disposition of said lifting cable.

3. The hoist as recited in claim 2 wherein said boom member includes a lower sleeve member that telescopically receives an upper sleeve member, and releasable connecting means for interconnecting said sleeve members and permitting establishing varying lengths for said boom member.

4. The hoist as recited in claim 3 wherein said boom member is pivotally connected to said mast member at a removable pin connection.

5. The hoist as recited in claim 4 wherein said tie member is a linked chain.

6. The hoist as recited in claim 4 wherein said sleeve members include removable connecting means for varying the length thereof.

7. The hoist as recited in claim 4 wherein said winch means is slidably disposed on said boom member and includes means for fixedly connecting said winch means at varying positions along the length of said boom member.

8. The hoist as recited in claim 4 wherein said cable guide means includes a grooved sheave rotatably connected at said upper end of said boom member.

9. The hoist as recited in claim 8 wherein said terminal end of said cable includes a cable tensioning weight and a lifting hook.

10. The hoist as recited in claim 5 wherein a chain hook is attached to said upper end of said mast member for selective retention of a link of said chain for controlling the effective length thereof and the inclination of said boom member.

11. The hoist as recited in claim 4 wherein said sleeve members include longitudinally series of alignable apertures and said connecting means includes removable pins insertable through aligned apertures for adjusting said length of said boom member.

12. The hoist as recited in claim 3 wherein winch means includes a connector cable for removable connection with a battery of the vehicle power supply.

* * * * *